United States Patent [19]

Chang

[11] 3,977,028

[45] Aug. 31, 1976

[54] TOILET ACCESSORY

[76] Inventor: Henry C. Chang, 625 Hurlingham Ave., San Mateo, Calif. 94402

[22] Filed: May 14, 1975

[21] Appl. No.: 577,391

[52] U.S. Cl. ..... 4/254

[51] Int. Cl.[2] ..... E03D 11/00

[58] Field of Search ..... 4/185 S, 185 HB, 185 H, 4/254

[56] References Cited

UNITED STATES PATENTS

| | | | |
|---|---|---|---|
| 2,285,900 | 6/1942 | Chapman | 4/185 B |
| 2,523,447 | 9/1950 | Reagan, Sr. et al. | 4/185 HB |
| 2,592,160 | 4/1952 | Kunes | 4/185 HB |
| 3,209,375 | 10/1965 | Parsons | 4/237 |
| 3,263,245 | 8/1966 | Ettinger | 4/254 |

*Primary Examiner*—Henry K. Artis

[57] ABSTRACT

A back rest is movably supported on a wall behind a toilet in a manner whereby in one position the back rest is above the toilet and free therefrom and rests against the wall and in another position the back rest is over the raised toilet lid in juxtaposition therewith and supports the back of a user of the toilet.

2 Claims, 5 Drawing Figures

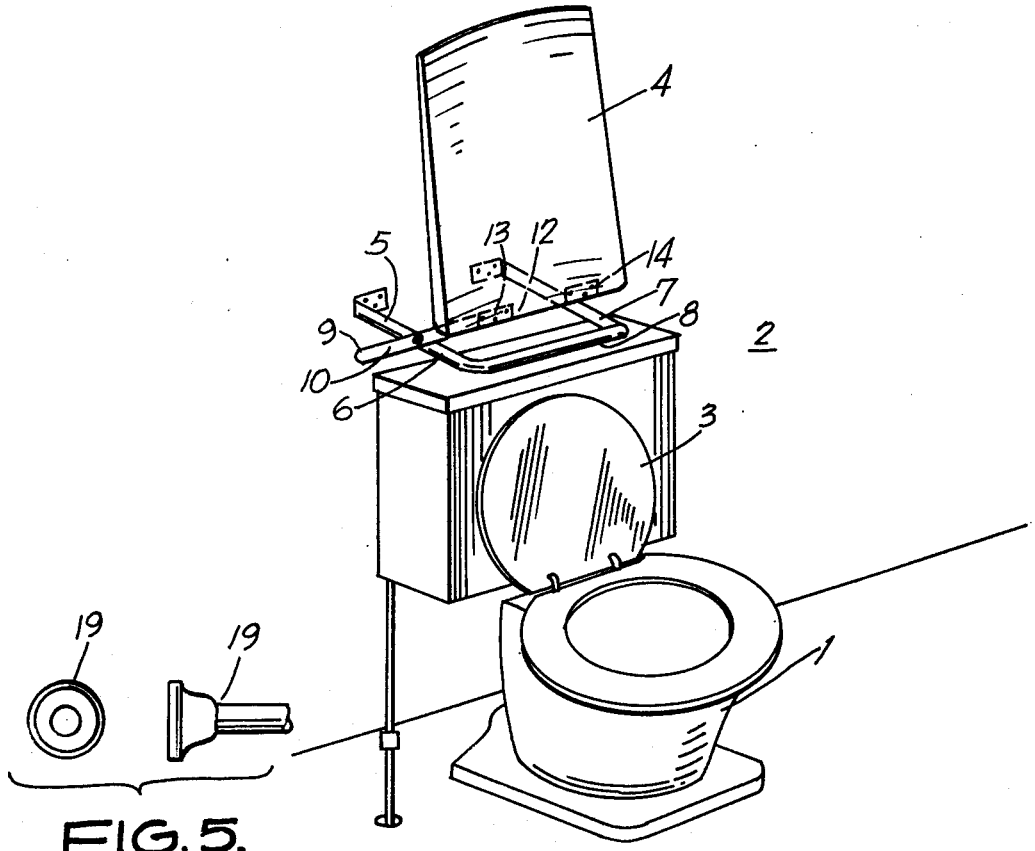
FIG. 5.
FIG. 1.
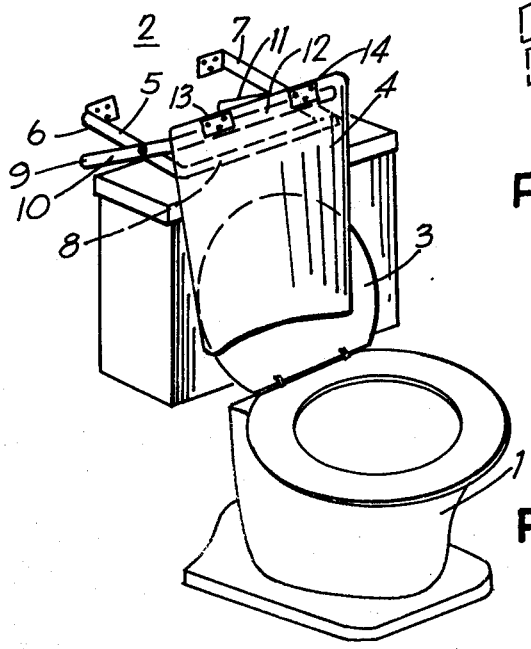
FIG. 2.
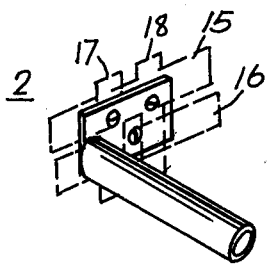
FIG. 4.
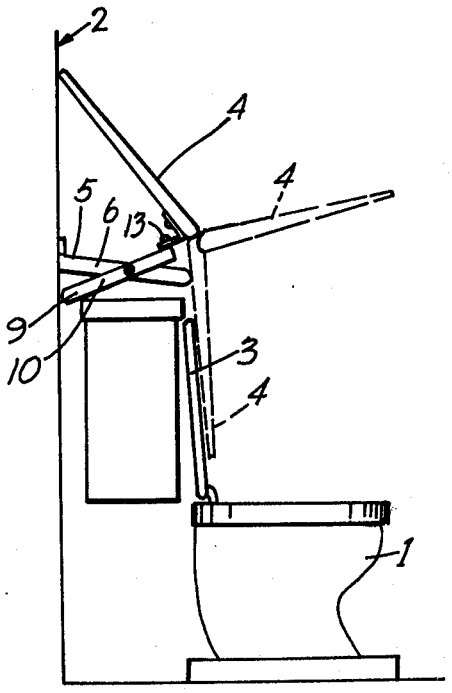
FIG. 3.

TOILET ACCESSORY

DESCRIPTION OF THE INVENTION

The present invention relates to a toilet accessory. More particularly, the invention relates to a toilet accessory for a toilet in proximity with a wall behind it.

Objects of the invention are to provide a toilet accessory of simple structure, which is inexpensive in manufacture, utilized with facility and convenience, and functions effectively, efficiently and reliably to support the back of a user when in use and to remain out of the way when not in use.

In order that the invention may be readily carried into effect, it will now be described with reference to the accompanying drawing, wherein:

FIG. 1 is a schematic diagram of an embodiment of the toilet accessory of the invention in its out of use position;

FIG. 2 is a schematic diagram of the embodiment of FIG. 1 in its position of use;

FIG. 3 is a side view of the embodiment of FIG. 1 illustrating its range of movement;

FIG. 4 is a schematic diagram of part of the toilet accessory of the invention illustrating a manner of affixing it to a wall; and FIG. 5 is an end view and a side view of part of the toilet accessory of the invention illustrating another method of affixing it to a wall.

In the FIGS., the same components are identified by the same reference numerals.

The toilet accessory of the invention is for a toilet 1 in proximity with a wall 2 behind it and having a lid 3 (FIGS. 1, 2 and 3).

The toilet accessory of the invention comprises a back rest 4 (FIGS. 1, 2 and 3). A support device movably supports the back rest 4 on a wall 2 behind the toilet 1 in a manner whereby in the position shown in FIG. 1 and in solid lines in FIG. 3 the back rest is above the toilet and free therefrom and rests against the wall, and in another position, shown in FIG. 2 and in broken lines in FIG. 3, the back rest is over the raised toilet lid 3 in substantially juxtaposition therewith and supports the back of a user of the toilet.

The support device comprises a support member 5 of substantially U-shape having a pair of spaced substantially parallel arms 6 and 7 affixed at corresponding ends to the wall 2 and a head 8 joining the arms at their free ends and substantially perpendicular thereto (FIGS. 1 and 2).

The support device further comprises a mounting member 9 of substantially U-shape having a pair of spaced substantially parallel arms 10 and 11 each affixed at a substantially intermediate area to a corresponding one of the arms 5 and 7 of the support member 6 and a head 12 joining the arms at their free ends and substantially perpendicular thereto, as shown in FIGS. 1 and 2.

Hinges 13 and 14 hingedly affix the back rest 4 to the head 12 of the mounting member 9 in a manner whereby the back rest 4 is movable substantially 180° around said head, as shown in FIG. 3, and is supported by the head 8 of the support member 5 in its position over the raised toilet lid 3.

The support and mounting members 5 and 9 may be affixed to the wall 2 in any suitable manner and by any suitable means, such as, for example, by screws or nails. As shown in FIG. 4, the support and mounting members may be affixed to the wall 2 by adhesive strips 15, 16, 17 and 18, for example, to prevent damage to tiles on the wall. The supporting and mounting members may be affixed to the wall 2 by suction cup devices 19, such as shown in FIG. 5.

While the invention has been described by means of a specific example and in a specific embodiment, I do not wish to be limited thereto, for obvious modifications will occur to those skilled in the art without departing from the spirit and scope of the invention.

I claim:

1. A toilet accessory for a toilet in proximity with a wall behind it and having a lid, said toilet accessory comprising a back rest; and support means movably supporting the back rest on a wall behind the toilet in a manner whereby in one position the back rest is above the toilet and free therefrom and rests against the wall and in another position the back rest is over the raised toilet lid in substantial juxtaposition therewith and supports the back of a user of the toilet.

2. A toilet accessory as claimed in claim 1, wherein the support means comprises a support member of substantially U-shape having a pair of spaced substantially parallel arms affixed at corresponding ends to the wall and a head joining the arms at their free ends and substantially perpendicular thereto, a mounting member of substantially U-shape having a pair of spaced substantially parallel arms, each affixed at a substantially intermediate area to a corresponding one of the arms of the support member and a head joining the arms at their free ends and substantially perpendicular thereto, and hinge means hingedly affixing the back rest to the head of the mounting member in a manner whereby the back rest is movable substantially 180° around the head of the mounting member and is supported by the head of the support member in its position over the raised toilet lid.

* * * * *